United States Patent [19]

Looney

[11] 4,234,180

[45] Nov. 18, 1980

[54] RECIRCULATING DOCUMENT HANDLER CONFIGURATION

[75] Inventor: John H. Looney, Fairport, N.Y.

[73] Assignee: Xerox Corporation, Stamford, Conn.

[21] Appl. No.: 52,526

[22] Filed: Jun. 27, 1979

[51] Int. Cl.[3] ..... B65H 1/06; B65H 1/30

[52] U.S. Cl. ..... 271/3.1; 271/65; 271/DIG. 9

[58] Field of Search ..... 271/DIG. 9, 3, 3.1, 271/4, 65, 186, 225

[56] References Cited

U.S. PATENT DOCUMENTS

| | | | |
|---|---|---|---|
| 700,722 | 5/1902 | Appel | 271/DIG. 9 |
| 3,227,444 | 1/1966 | Egan | 271/65 |
| 3,630,515 | 12/1971 | Knapp | 271/4 |
| 3,672,765 | 6/1972 | Altmann | 271/DIG. 9 |
| 3,844,654 | 10/1974 | Guenther | 355/24 |
| 3,856,295 | 12/1974 | Looney | 271/65 |
| 4,023,791 | 5/1977 | Hori et al. | 271/4 X |
| 4,054,285 | 10/1977 | Stange et al. | 271/186 |
| 4,076,408 | 2/1978 | Reid et al. | 271/258 X |
| 4,099,150 | 7/1978 | Connin | 271/3.1 X |
| 4,140,387 | 2/1979 | Gustafson | 271/3.1 X |
| 4,153,241 | 5/1979 | Batchelor et al. | 271/4 |
| 4,158,500 | 6/1979 | DiFrancesco | 271/3.1 |
| 4,159,824 | 7/1979 | Stange et al. | 271/3 |
| 4,166,614 | 9/1979 | Hamlin et al. | 271/3.1 |

FOREIGN PATENT DOCUMENTS 53-106131 9/1978 Japan .
53-118138 10/1978 Japan .

OTHER PUBLICATIONS

IBM Technical Disclosure Bulletin; vol. 19, No. 12, May, 1977, p. 4496, "Duplex Document Feeder", M. K. Bullock.

IBM Technical Disclosure Bulletin; vol. 18, No. 1, Jun. 1975, p. 40, "Sheet Turnover Device", S. R. Harding.

IBM Technical Disclosure Bulletin; vol. 14, No. 5, Oct. 1971, p. 1547, "Document Feed", J. C. Rogers et al.

*Primary Examiner*—Robert W. Saifer

[57] ABSTRACT

A compact and low profile document handling unit with short and simple document recirculation paths for recirculating a set of original document sheets to and from one side of the platen of a copier with or without inversion for selective repeated copying of one or both sides of the documents, in which the selectable document inverter in the document recirculation path includes a generally planar document sheet reversing chute which is generally parallel to and closely overlying the platen and a sheet reversing feeder adjacent the same side of the platen for feeding the document sheets into the reversing chute directly from the platen, but inverted, and for feeding them out of the reversing chute to a restacking tray at that same side of the platen without inversion.

11 Claims, 4 Drawing Figures

1/2

RECIRCULATING DOCUMENT HANDLER CONFIGURATION

The present invention relates to an improved automatic document handling system for providing precollation copying of one or both sides of documents with a compact over-platen document inverting path.

As xerographic and other copiers increase in speed, and become more automatic, it is increasingly important to provide higher speed yet more reliable and more automatic handling of both the copy sheets and the individual original documents being copied. The providing of duplex copying capabilities and pre-collation copying capabilities greatly complicates and increases the copier document and copy sheet handling complexities.

The term "duplex copying" may be more specifically defined into several different, individually known, copying modes. In duplex/duplex copying, both sides of a duplex document sheet (which has images on both sides) are copied onto both sides of a single copy sheet. In duplex/simplex copying, both sides of a duplex document are copied onto only one side of two successive copy sheets. In simplex/duplex copying, the images of two successive simplex document sheets, which have images on only one side, are copied onto opposite sides of a single copy sheet. In contrast, in simplex/simplex copying, one-sided documents are conventionally copied onto one sided copy sheets. In the printing industry, as opposed to the copier industry, two-sided copying may be referred to as "backing-up" rather than duplex copying. The document handling system disclosed herein is capable of recirculating either simplex or duplex documents for any of these copying modes.

Alternative simplex/duplex or duplex/duplex or duplex/simplex or simplex/simplex pre-collation copying is disclosed in an allowed U.S. application Ser. No. 825,743, filed Aug. 18, 1977, and published Mar. 1, 1979, as German OLS 2,828,669, and in a related U.S. Pat. No. 4,166,614 issued Sept. 4, 1979 and filed on the same date. Other examples of duplex/duplex pre-collation copying systems are also disclosed in Eastman Kodak U.S. Pat. Nos. 4,099,150 and 4,140,387.

The duplex copying of the copy sheets (for either duplex/duplex or simplex/duplex copying) may be done by first making in the copier processor a set of simplexed copy sheets of only the odd or the even document pages (printed only on their first sides) and temporarily storing those simplex copy sheets in a duplex buffer tray, and then feeding them back through the same copying processor for a second pass printing of the opposite order (even or odd page) document images on the opposite sides of the copy sheets. Such systems may be referred to as sequential or dual pass duplexing systems. Examples of such systems for handling the copy sheets being duplexed are shown in U.S. Pat. Nos. 3,615,129, issued Oct. 26, 1971 to W. A. Drawe, et al.; 3,645,615, issued Feb. 29, 1972, to M. R. Spear, Jr.; and 3,851,754, issued Oct. 15, 1974, to E. E. Drexler et al. on duplex/duplex. Of interest as disclosing a pre-collation duplex copying system, in addition to art cited above, are U.S. Pat. Nos. 3,630,607, issued Dec. 28, 1971, to H. Korn and 4,116,558, issued Sept. 26, 1978, to J. A. Adamek et al..

A desirable feature for a copier is to provide automatic document recirculation for pre-collation copying. As discussed, for example, in detail in U.S. Pat. No. 3,963,345, issued June 15, 1976, to D. J. Stemmle, et al., at Columns 1–4, and the above-cited Adamek patent, such pre-collation copying systems provide a number of important advantages. The copies exit the copier in pre-collated sets, and do not require subsequent sorting in a sorter or collator. Any desired number of such copy sets may be made by making a corresponding number of recirculations of the document set in collated order past a copying station and copying each document once each time it recirculates. On-line finishing and/or removal of the completed copy sets may be provided while additional copy sets are being made from the same document set.

However, a disadvantage of pre-collation copying systems is that the documents must all be repeatedly circulated, and copied in a pre-determined order only once in each circulation, by a number of circulations equivalent to the desired number of copy sets. Thus, it may be seen that increased document handling is necessitated for a pre-collation copying system, as compared to a conventional post-collation copying system. Maximizing document handling automation and copying cycle efficiency is particularly important in pre-collation copying. If the document handler cannot circulate and copy documents in coordination with the copy sheets in the correct order, the total copying time for each copy set will be increased.

In a post-collation copying system, all the desired copies are made at one time from each document page and collated by being placed in separate sorter bins. The document set need only be circulated once and multiply copied to fill bins of the copy sheet sorter or collator with the corresponding number of copy sets desired. However, the number of copy sets which can be made in one circulation is limited by the number of available bins, and the sorter adds space and complexity and is not well suited for on-line finishing.

Some examples of art relating to pre-collation document handling units in which each document sheet is withdrawn from the bottom of a document set stack for copying once in each circulation and then returned to the top of the document stack for repeated copying circulations include, besides art cited above: German Patentschrift No. 1,228,295, Oct. 25, 1962; and U.S. Pat. No. Re. 27,976, (originally U.S. Pat. Nos. 3,499,710, issued Mar. 10, 1970) to L. W. Sahley; U.S. Pat. No. 3,536,320, issued Oct. 27, 1970, to D. R. Derby; U.S. Pat. No. 3,552,739, issued Jan. 5, 1971, to R. R. Roberts, et al.; U.S. Pat. No. 3,556,511, issued Jan. 19, 1971, to A. Howard, et al.; U.S. Pat. No. 3,888,579, issued June 10, 1975, to V. Rodek et al.; and U.S. Pat. No. 3,937,454, issued Feb. 10, 1976, to R. H. Colwill. A recent example of a recirculating pre-collation copying system of this type with circuitry and switches for counting the number of documents recirculated and for counting the completion of each set circulation, is shown in U.S. Pat. No. 4,076,408, issued Feb. 28, 1978, to M. G. Reid et al.. Other examples of document sheet sensors are disclosed in U.S. Pat. No. 3,790,158, issued Feb. 5, 1974, to J. E. Summers et al., which also disclosed recirculating documents to and from a stack at one side of a platen to a fixed registration edge with a reversable platen belt.

As to some examples of further art relating to specific features of this disclosure, a selective document inverting roller at one side of a platen is disclosed in IBM Technical Disclosure Bulletin Vol. 14, No. Oct. 5, 1971, p. 1547. A document platen belt which is deformed adjacent platen registration fingers is disclosed in U.S.

Pat. No. 3,910,570, issued Oct. 7, 1975, to C. D. Bleau. Multiple platen belts are disclosed in U.S. Pat. No. 3,844,552, issued Oct. 29, 1974, to C. D. Bleau et al.. A stationary spaced over-platen plate with a small area document ejection drive is disclosed in U.S. Pat. No. 3,888,581, issued June 10, 1975, to J. R. Caldwell. A sheet reversing chute system of the type disclosed herein is disclosed in U.S. Pat. No. 3,856,295, issued Dec. 24, 1974, to the subject inventor. Inverting and stacking documents on top of a platen cover rather than on the document stack at the side of the platen is disclosed in Japanese Application No. 52-21280, laid-open Sept. 14, 1978, as laid-open No. 53-106131 by Ricoh.

Examples of copier systems with general document and sheet handling control systems are described in U.S. Pat. Nos. 4,062,061, issued Dec. 6, 1977, to P. J. Batchelor et al.; 4,078,787, issued Mar. 14, 1978, to L. E. Burlew et al.; 4,099,150, issued July 4, 1978, to J. L. Conin; 4,123,155, issued Oct. 31, 1978, to W. L. Hubert; 4,125,325, issued Nov. 14, 1978, to P. J. Batchelor et al.; and 4,144,550, issued Mar. 13, 1979, to J. M. Donohue et al..

Conventional integral software incorporation into the copier's general microprocessor logic circuitry and software of the functions and logic defined herein as taught by various of the above-cited patents is preferred. However, it will be appreciated that the functions and systems disclosed herein may be alternatively conventionally incorporated into a copier utilizing any other suitable or known copier software or hard wired logic systems, cam-bank switch controllers, etc. The output control of the exemplarly sheet handling systems disclosed herein may be accomplished by activating known electrical solenoid controlled sheet deflector fingers and drive motors or their clutches in the indicated sequences, and conventional sheet path sensors or switches may be utilized for counting and keeping track of the positions of documents and copy sheets.

All of the patents cited herein for background or art purposes are also incorporated by reference herein to the extent they provide teachings of usable or alternative systems or hardware for the disclosed embodiments herein.

A preferred feature of the invention is to provide, in a document handling unit for recirculating original document sheets to and from a set of document sheets in a recirculation path to and from the platen of a copier for selective repeated copying of one or both sides of said document sheets, the improvement wherein said document handling unit includes a selectable document inverter in said document recirculation path comprising a generally planar document sheet reversing chute which is generally parallel to and closely overlying said platen and a reversing sheet feeder adjacent a first side of said platen for feeding said document sheets into and out of said reversing chute, to provide a compact and low profile document handling unit.

Further features and advantages of the invention will be better understood by reference to the following description, and to the drawings forming a part thereof, wherein.

Figure 1:
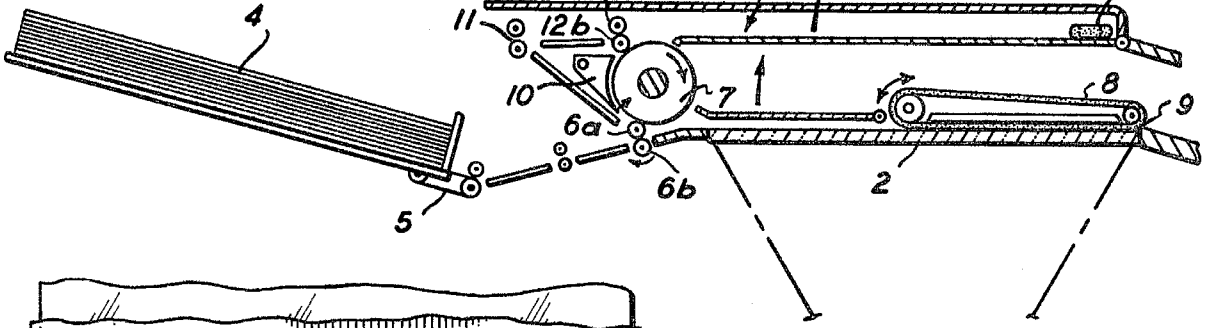
FIG. 1 is a side view of an exemplary document handling unit incorporating the present invention mounted over a copier platen.
Figure 2:
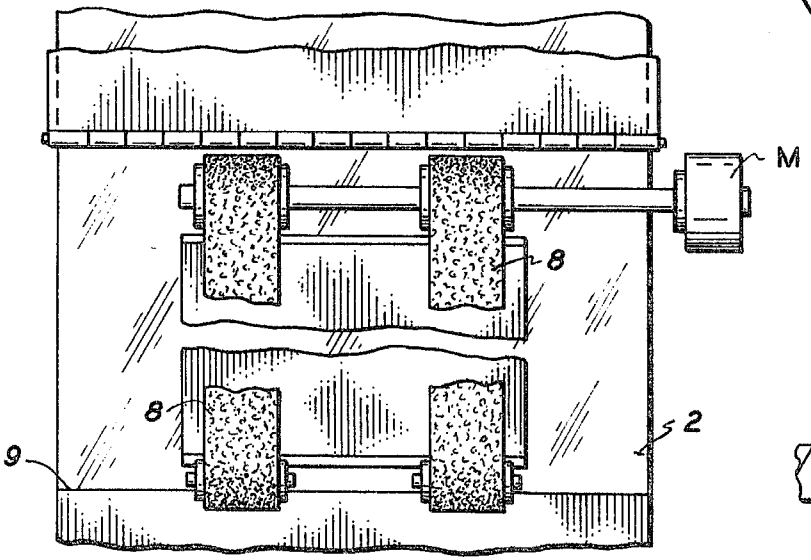
FIG. 2 is a partial top view of the document handling unit of FIG. 1.
Figure 3:
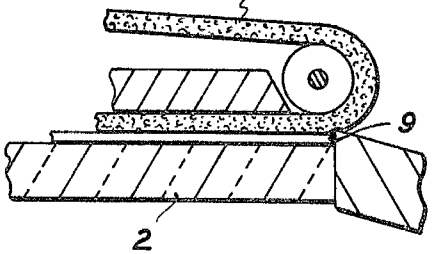
FIG. 3 is an enlarged portion of FIG. 1 illustrating the disclosed document registration system.

Referring to the exemplary automatic document feeding unit 1 shown in FIG. 1–4, it will be appreciated that various document feeders and copiers may be utilized with the present invention other than those disclosed herein, including various ones disclosed in the above-cited references.

In the recirculating document handler (RDH) 1 here, individual original documents are sequentially fed from the bottom of a stack of documents 4 (placed by the operator face-down in the document storage area or stacking tray) directly to the imaging station, which is the conventional platen 2 of the copier, to be conventionally imaged onto a photoreceptor for the making of copies in a conventional xerographic manner. The documents are thus circulated in 1 to N order, i.e., first to last or forward serial order, for simplified copy duplexing and job recovery. The document handler 1 has conventional switches for sensing and counting the individual documents fed from the stack 4, i.e., counting the number of document sheets circulated. A conventional resettable bail and its associated switch will be provided on the stack 4 to indicate the completion of each circulation of the complete document set and be automatically reset on the top of the stack before the next circulation. The document sheets may be conventional sizes and weights of sheets of paper or plastic containing information indicia to be copied, e.g., printed or typed letters, drawings, prints, photographs, etc.. A bottom feeder 5 feeds the bottom document sheet, on demand, to a platen sheet feeder **6*a* and 6*b* and 7 which moves the document onto and off of the copier platen. With this document feeder unit 1, the documents are not inverted as they are fed from the tray to the imaging station. They are selectively inverted, if inversion is desired, by an inverter 3 in the return path of the document from the platen to the stack 4 after copying. The inverter 3** provides for inverting duplex documents so that their opposite sides may be copied.

Referring particularly to FIG. 1, the document sheets to be copied are fed individually from the stack 4 by a bottom feeder 5, both of which are closely adjacent one side of the platen 2. Each document is fed onto the platen here by an input roller pair **6*a* and 6*b*, which may be directly driven by engagement of the roller 6*a* by a large roller 7 driven in the direction arrow shown. The registration of the document on the platen is accomplished on the platen here by the belts 8 and a fixed raised registration edge 9. (Note FIGS. 2 and 3). Reversal of the registration belts 8 by motor M after copying drives the document back toward the nip between the roller 6*a* and the roller 7, which transports the document into a diverter gate 10**.

If the lip of the gate 10 is moved up, as shown by the movement arrow thereon, it will deflect the document directly into the nip of the return roller pair 11, which will return the document directly to the top of the stack 4, so that the documents may be recirculated in maintained collated order without inversion. Thus, in this mode of operation, utilized for simplex documents, the document inverter 3 is not utilized.

For duplex documents the inverting gate 10 is held down, so as to deflect the documents being returned from the platen around the outside of the roller 7 and into the nip between the roller 7 and a roller **12*b*, which may be driven by its engagement therewith. The document, now inverted, is driven into the pocket or chute of the document inverter 3, until it strikes a resilient reversing pad 13 of a known type at the end thereof, which bounces the document back into the nip between the rollers 12***a* and 12*b*, which drive the document into the same return roller pair 11 for restacking on the stack 4 in inverted orientation compared to its original orientation in the stack, (but in the same collated document order).

Note that the document inverter 3 here is a compact "Y" configuration with an inverting chute which is parallel to and closely spaced above the platen, so as to reduce the size of the RDH unit 1. The chute may be the same size as the platen since it is overlying the platen. It may be hinged as shown to pivot up away from the platen 2 for jam clearance or other desired platen access. It is preferably also semi-transparent.

The entire RDH 1 may be a compact lightweight unit which may be pivotably or otherwise removed from the platen 2 to allow alternative manual copying, yet can provide continuous document recirculation for pre-collation copying. With this RDH 1 the first document page in the stack 4 may be copied immediately in every circulation, and the entire document recirculation path is very short, thus desirably reducing the movement velocity of the documents need to keep up with the copying rate of the copier. The simplex document path is shorter than the duplex path, which is preferable, since that is the more commonly used mode. Clear and simple document loading and jam clearance access is provided.

To restate the above, after the document sheet has been copied, there is a decision gate 10 in the document path adjacent the downstream end of the platen comprising pivotable deflector fingers, which determines the further recirculatory movement of the documents through a selected one of two different return transport paths back to the document stack 4. These two paths are a first (simplex) transport path and a second (duplex) transport path. The first or simplex transport path returns the documents to the same restacking tray without any inversions. The second or duplex transport path 58 returns the documents for restacking with only a single inversion. Therefore, the solenoid or other actuation of the selector gate 10 determines whether the documents are recirculated with a total of none or one inversions. With no inversions (the simplex path) the same sides of the documents are exposed in each circulation and are restacked in the tray in each circulation in their original orientation. With one inversion (the duplex path) the documents are restacked in the tray inverted from their previous orientation, which provides for copying of the opposite sides or faces of the documents on their next circulation, i.e., for copying duplex documents. The duplex path transport here comprises the disclosed three roller (7, 12*a*, 12*b*) sheet inverter and the over-platen reversing chute 3.

Both the simplex transport path and duplex transport path continuously and rapidly restack the sheets after they are copied on the top of the stack 4 of sheets in the document tray without interferring with simultaneous bottom feeding. Thus, continuous multiple recirculations for pre-collation copying can be provided.

Figure 4:
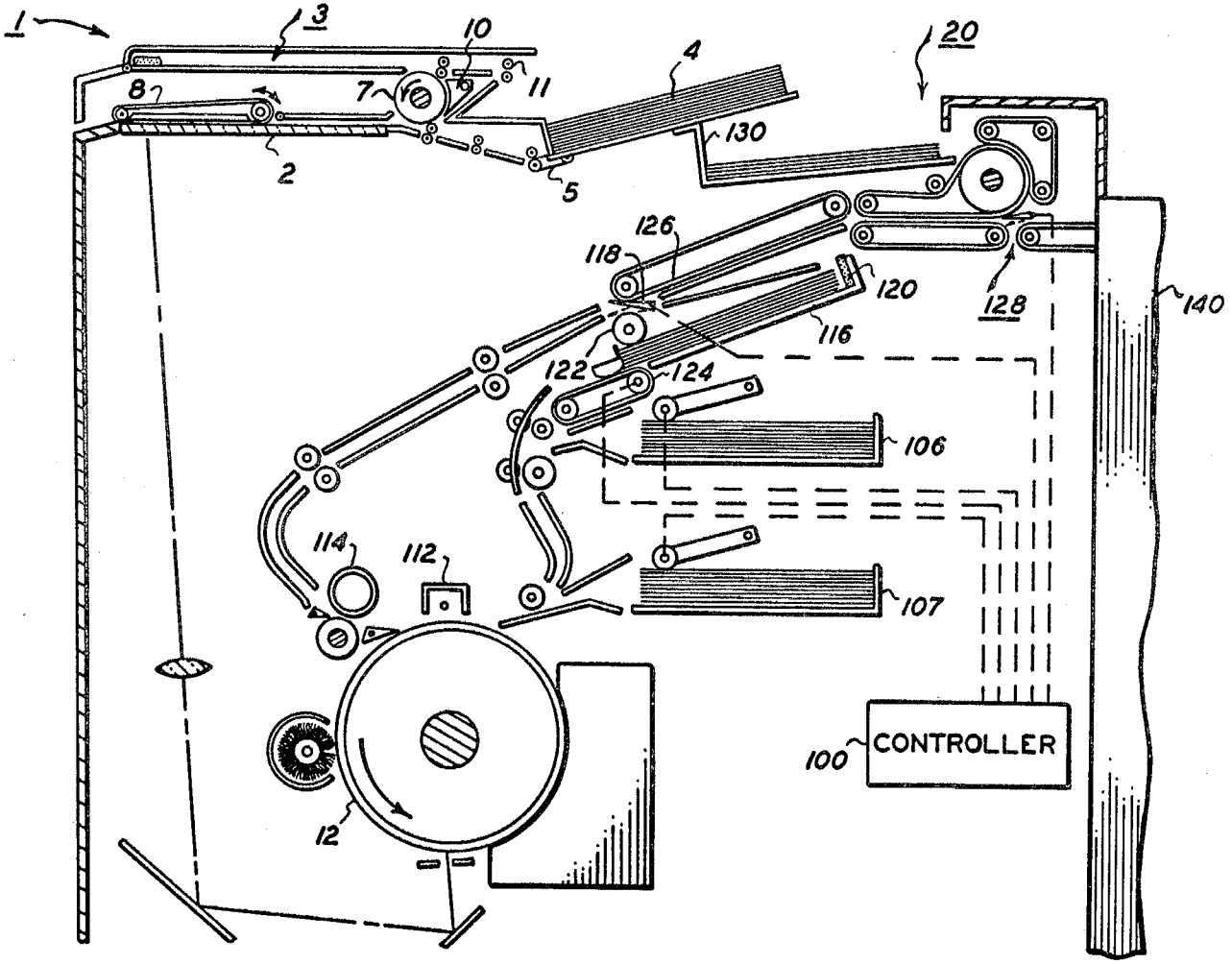
FIG. 4 shows the document handling unit of FIG. 1 on an exemplary duplex xerographic copier.

Referring to FIG. 4, an exemplary copier 20 processor and its controller 100 will now be described. This copier system is disclosed in more detail in the above-cited allowed U.S. applications Nos. 825,743 and 825,751 and German OLS No. 2,828,669. It provides duplex or simplex pre-collated copy sets from either duplex or simplex original documents copied from the RDH 1. Two separate copy sheet trays 106 and 107 are provided here to feed clean copy sheets onto which the images of the documents are to be printed. The control of sheet feeding is by the machine controller 100. The controller 100 is preferably of the known programmable microprocessor type exemplified by the patents cited in the introduction, which conventionally also controls all of the other machine functions described herein including the operation of the document feeder, the document and copy sheet gates, feeder drives, etc.

The copy sheets are fed from trays 106 or 107 to the conventional xerographic transfer station 112 for imaging one side thereof, then to the conventional fusing station 114. From there, depending on the position of a duplex selector finger or gate 118, the copy sheets will be deflected either into a duplex buffer intermediate storage tray 116 for duplex copies, or into the copy output path of the copier via an output transport 126. The copy sheets stacked into the duplex tray 116 are stacked image face-up in the order in which they were copied. The duplex tray 116 here includes a bounce reverser 120 and jogger/normal force wheels 122 for assisting the stacking of copy sheets therein and assistance in bottom feeding from the duplex tray 116 by a bottom feeder 124. For duplex copying the previously simplexed copy sheets in the tray 116 are fed by the feeder 124 back to the transfer station 112 for the imaging of their second or opposite side page image. Such now-duplexed copy sheets are then fed out past the now-opened gate 118 into the same output transport 126.

The output transport 126 transports the finished copy sheets to an output tray 130 through a gate 128 and inverter as shown, or, preferably, to a finishing station 140 for the stapling, stitching, gluing, binding, and/or off-set stacking of the completed, pre-collated, copy sets. The copy sheets may be stacked in an output tray or in the finisher in a compilier tray in the order produced, without inversion for simplex copies, or with an inverter or inversion in the output path for duplex copies, in this 1 to N system, in which the odd page side is the second side imaged and the copies are inverted inherently by the processor before the output.

By way of further background, it is known that reproducing machines which do both simplexing and duplexing must maintain proper collation for both types of copy sheets in the output tray. For simplex copy sheets generated in forward serial order, the copy sheets will be properly collated if they are output stacked in that order (1, 2, 3, 4, etc.) face-down in the output tray. Thus, when the operator picks up and turns over the stacked set of completed copy sheets, it will be in the proper forward serial page order (1 to N) from the top of the stack to the bottom. For duplex copies there is the additional requirement that the lower document page number be on the top of the copy sheet and the next higher document page number be on the bottom of the same copy sheet, so that the completed copy set is in the order $\frac{1}{2}$; $\frac{3}{4}$; 5/6; etc.

As disclosed in the cited U.S. Pat. No. 4,116,558, preferably for simplex/duplex copying only the even page documents are copied in the first document circulation by copying every other document sheet starting with the second document sheet. The odd document pages are circulated, but not copied in this first circulation. Thus, an even side buffer set is preferably always placed in the duplex tray. After the first document circulation, all but the last subsequent circulations proceed with copying of all simplex document pages in each circulation onto copy sheets fed alternately from the copy tray and duplex tray. Then on the last document set circulation only the odd document pages are copied.

Referring now to the duplex/duplex system which can be compatibly provided here, the duplex documents may also be loaded face-down and copied in the same 1 to N (forward serial) order from the same single document tray. Here the document inverter for the duplex documents is downstream of the platen rather than upstream. Thus, the duplex documents may be first run through a single dummy (non-copying) circulation with inversion to restack the documents inverted in the DH tray from their initial orientation. Thus, the even sides of the duplex documents may be copied on the second (first copying) circulation. On all subsequent circulations (up to the final one) every duplex document sheet is copied on one side and then inverted before restacking as described in the above-cited U.S. applications Ser. Nos. 825,743 and 825,751, and OLS No. 2,828,669. That is, all the even document page sides may be copied on one circulation and placed in the duplex tray, then all the odd sides copied in the next circulation onto the opposite sides of that buffer set fed from the duplex tray, etc., etc. The duplex documents are inverted during all but the last circulation. On the last duplex document copying pass the documents are all copied but are not inverted. Therefore, they are automatically re-collated in the document handler tray during this last copying circulation.

As may be seen from the above description, the disclosed document handling unit provides a compact and low profile unit. Unlike a "race track" system in which the documents are recirculated and removed from a stack and feeder overlying the platen, the thickness, weight, mass and inertia of the portion of the RDH 1 overlying the platen can be much lower. The document stack 4 here is at one side, and may be separately mounted, i.e., fixed, or removable separately. Thus, the mass and weight of the document stack, the document tray, the document feeder, etc., need not be lifted when only the over-platen portion of the unit 1 is lifted away from the platen to provide manual copying. The sheet reversing unit and its drives and the sheet feed rollers may likewise be separately mounted to the copier, rather than pivoting over the platen for manual copying. The low mass of the over-platen portion makes it safer and easier to lift and does not require heavy springs or counterbalances.

Additionally, with the short and direct and simple document sheet paths which are provided with this system, the document feeders need only move the documents at less than 40 centimeters per second, for example, yet can feed documents onto and off of the platen rapidly enough to keep up with the full copying rate of a 40 to 50 copies per minute flash exposure copier, for example.

Because both the top and bottom planar plates forming the inverter chute 3 may be independently or commonly pivotable in either direction, and may be transparent or semi-transparent, and because the inverter chute 3 forms the removable top of the platen cover, virtually the entire document path may be readily visible. I.e., a document jam at any point may be readily spotted and the document easily removed. There are no long document belt paths from which a jammed document must be pulled.

The disclosed system is particularly desirable in a document handling system in which the documents are fed the long way, i.e., short edge first. This type of document feeding system normally requires a longer inverter chute since the document is being inverted in its longest dimension. However, with the present system, the overall dimensions of the document handling unit do not have to be increased to provide such a longer inverter chute, since the reversing chute is utilizing the existing space available under the platen cover unit overlying the platen, and in fact, is forming the removable top cover of the platen cover unit.

If a document sheet jam occurs anywhere in the document return to the stack after copying, including anywhere in the inverting and reversing path for duplex documents, the document may simply be taken out of the exposed path by lifting up the inverting chute and placed back on top of the stack. Document set collation will be preserved.

The disclosed document handling unit is particularly suitable for alternatively or additionally providing a non-pre-collation copying mode in which multiple copies are made from the documents and they are not recirculated. The documents can be placed in the same manner (face-down) in a stack, or manually fed one at a time face-down like a semi-automatic document handler. That is, the same, logical, document placement is provided for all copying modes.

As an additional feature, if the documents are not being recirculated, or have completed their last circulation, they may be left in the inverter 3 chute rather than restacked by disabling the return feed rollers or introducing another gate. This leaves the document tray and the platen clear for the operator to add additional documents to the stack 4 to be copied without interrupting the document feeding.

Although the present invention is not limited to the particular document sheet feeding means and reversing sheet feeder disclosed, it will be appreciated that the disclosed system comprises a very simple integral and unidirectionally driven multi-drive-roll unit with a simple integral selectively positionable sheet deflector gate, which is adapted to both invert and insert the document sheets into the reversing chute directly from the platen and also to feed the document sheets from the reversing chute directly back to the document set without an inversion, or alternatively to feed the document sheets from the platen directly back to the document set without inversion, bypassing the chute.

With the disclosed configuration the document sheets are maintained in a single stack directly adjacent only one side of the platen and are individually fed to and from the same side of the platen from the same side of that stack. The distance between the stack and the platen, i.e., the document path therebetween, may be substantially shorter than the smallest dimensions of the document being fed. The return path for simplex documents here is almost equally short. The return path for duplex documents, even with inverting, is only increased here by substantially twice the dimension of the document being fed, i.e., the distance required to move that document dimension in and out of its inverting and reversing path.

As an example of one alternative to the disclosed duplex document inverting system, the inverting path to the chute could be inside of the roller 7, rather than outside as shown here, if the roller 7 were reversibly driven and another idler roller was provided at the platen side of the roller 7 and the roller pairs 6*a* and *b* and 12*a* and *b* were replaced with single idler rollers. However, the present dual rollers 6*a* and 6*b* advantageously allow one document sheet to be fed onto the platen while another is being simultaneously removed, i.e., partially overlapping in position and time.

What is claimed is:

1. In a document handling unit for recirculating original document sheets to and from a set of document sheets in a recirculation path to and from the platen of a copier for selective repeated copying of one or both sides of said document sheets, the improvement wherein:

said document handling unit includes a selectable document inverter in said document recirculation path comprising a generally planar document sheet reversing chute which is generally parallel to and closely overlying said platen to provide a compact and low profile document handling unit, and wherein said selectable document inverter further comprises a sheet feeder adjacent a first side of said platen for feeding said document sheets from said platen into and out of said reversing chute from said same first side of said platen to invert document sheets in said document recirculation path after they are copied on said platen and before they are returned to said set of document sheets, and wherein said selectable document inverter further comprises a selectively positionable document sheet deflector gate adjacent said first side of said platen for selectively bypassing said reversing chute to feed document sheets from said platen directly back to said document set or for alternatively feeding document sheets from said platen into said reversing chute for inversion as they are returned to said document set from said platen.

2. The document handling unit of claim 1 wherein said document sheet reversing chute is pivotally mounted over said platen for pivotal movement away from said platen.

3. The document handling unit of claim 1 wherein said document handling unit includes a document tray in which the document set is restacked during said document recirculation, said document tray being positioned adjacent said same first side of said platen and said reversing sheet feeder to provide a short recirculation path therebetween.

4. The document handling unit of claims 1, 2 or 3 wherein said selectable document inverter is positioned in said document recirculation path to invert document sheets after they are copied on said platen, and wherein said reversing sheet feeder is adapted to insert document sheets into said reversing chute directly with one inversion from said platen and to feed document sheets from said reversing chute directly without inversion back to said document set.

5. The document handling unit of claims 1, 2 or 3, wherein said reversing chute has approximately the same dimensions as said platen and includes reversing means therein for reversing the direction of movement of document sheets therein.

6. The document handling unit of claims 1, 2 or 3, wherein said document handling unit further includes document platen feeding means for feeding said documents onto and off of said platen from said same first side of said platen.

7. The document handling unit of claim 6, wherein said document platen feeding means and said reversing sheet feeder comprise an integral and unidirectionally driven multi-drive-roll unit with a selectively positionable sheet deflector gate for selectively feeding document sheets from said platen directly back to said document set without inversion or for alternatively feeding document sheets from said platen into said reversing chute for a single inversion as they are returned to said document set from said platen.

8. In a document handling unit for recirculating a stacked set of document sheets individually in a recirculation path to and from a platen of a copier with means for selectable inversion of the document sheets, for selective repeated copying of one or both sides of said document sheets, wherein said document handling unit includes a document tray adjacent a first side of said platen in which said document set is restacked during said document sheet recirculation, and means for feeding said document sheets directly from the bottom of said stack from said document tray to said platen at said first side thereof without inversion, the improvement in said means for selectable document inversion comprising:

a generally planar document sheet reversing chute mounted generally parallel to and closely overlying said platen, and defined by generally parallel and closely spaced apart pivotably mounted guide members confining a document sheet therein to a reversing path generally parallel to and closely overlying said platen and extending to and from said first side thereof, said reversing chute including reversing means for reversing the direction of movement of document sheets therein, wherein said guide members of said document sheet reversing chute are pivotably movable away from said platen to expose said reversing chute and said platen for document sheet removal therefrom; and integral sheet feeding and inverting means, including integral document sheet deflector gate means, mounted adjacent said first side of said platen between said platen and said reversing chute, said integral sheet feeding and inverting means providing selectable feeding of said document sheets after they are copied from said first side of said platen back to said tray in a first or a second path, said first path extending directly from said platen back to the top of said stack in said tray without inversion, said second path extending from said platen through an inversion path at said one side of said platen and into said reversing chute and then directly out from said reversing chute back to the top of said stack in said tray without inversion, wherein said selection between said first and second paths is provided by said integral deflector gate means, wherein in said first path said document sheets are recirculated with no inversions in the entire said recirculation path, and wherein in said second path said document sheets are recirculated with only a single inversion in the entire said recirculation path;

whereby said document handling unit has a minimal heighth above said platen but provides feeding of one-sided document sheets from said platen directly back to said document tray without inversion, and selectively alternatively provides feeding of two-sided documents from said platen back to said tray through a single inversion path closely adjacent said platen and a document reversing path closely overlying said platen so that said two-sided documents are restacked in said document tray inverted from their original orientation therein.

9. The document handling unit of claim 8, wherein said integral sheet feeding and inverting means is driven in the same direction for both said first and second document sheet paths.

10. The document handling unit of claim 8 or 9, wherein said integral sheet feeding and inverting means comprises a single large diameter unidirectionally driven roller means driving first and second pairs of smaller diameter roller means at opposite sides of said large roller means, said first pair of smaller roller means being positioned adjacent said first edge of said platen and said second pair of smaller roller means being positioned adjacent said reversing chute.

11. A method of document handling in which original document sheets are recirculated in a recirculation path from a stack of said document sheets to and from the platen of a copier for selective repeated copying on said platen of one or both sides of said document sheets, and in which said stack of said document sheets is maintained adjacent one side of said platen, the improvement wherein:

said document sheets are individually fed from the bottom of said stack onto one side of said platen without inversion to be copied and then are returned to the top of said stack from said one side of said platen, said document sheets, if they are to be copied on only one side, are fed directly back from said one side of said platen to said stack without inversion, so that said document sheets being copied on only one side are restacked with no inversions from their original orientation in said stack in said recirculation path, and said document sheets, if they are to be copied on both sides, are fed back from said platen to said stack in an inverting and "Y" shaped reversing path in which the document sheets are inverted once adjacent said same one side of said platen and are then reversed in direction at a reversing position and in a reversing path which is closely overlying and generally parallel to said platen and extends to and from said same one side of said platen, and then said inverted and reversed document sheets are fed back out of said reversing position from said one side of said platen directly and without inversion onto the top of said stack so that said document sheets being copied on both sides are restacked with one inversion from their original orientation is said stack in said recirculation.

* * * * *